US012589911B2

(12) United States Patent
Ji

(10) Patent No.: US 12,589,911 B2
(45) Date of Patent: Mar. 31, 2026

(54) PACKAGING BOX

(71) Applicant: BEAR ROBOTICS KOREA, INC., Seoul (KR)

(72) Inventor: Eunyoung Ji, Seoul (KR)

(73) Assignee: BEAR ROBOTICS KOREA, INC., Seoul (KR)

( * ) Notice: Subject to any disclaimer, the term of this patent is extended or adjusted under 35 U.S.C. 154(b) by 0 days.

(21) Appl. No.: 18/237,541

(22) Filed: Aug. 24, 2023

(65) Prior Publication Data

US 2025/0026537 A1 Jan. 23, 2025

(30) Foreign Application Priority Data

Jul. 21, 2023 (KR) ..... 10-2023-0095387

(51) Int. Cl.
*B65D 25/20* (2006.01)
*B65D 25/30* (2006.01)
*B65D 81/05* (2006.01)

(52) U.S. Cl.
CPC ..... *B65D 25/20* (2013.01); *B65D 25/30* (2013.01); *B65D 81/053* (2013.01); *B65D 2581/055* (2013.01)

(58) Field of Classification Search
CPC ..... B65D 25/20; B65D 25/30; B65D 88/54; B65D 88/542; B65D 2519/00805; B65G 69/28; B65G 69/287; B65G 69/30
See application file for complete search history.

(56) References Cited

U.S. PATENT DOCUMENTS 4,184,625 A * 1/1980 Stollberg ..... B65D 85/34 206/521.1
5,133,459 A * 7/1992 Genix ..... B65D 81/107 206/335
6,105,511 A * 8/2000 Bridges ..... B65D 19/0026 312/265.5

* cited by examiner

*Primary Examiner* — Andrew T Kirsch
(74) *Attorney, Agent, or Firm* — Birch, Stewart, Kolasch & Birch, LLP

(57) ABSTRACT

Disclosed is a packaging box. The packing box includes: a main body portion having a front surface and a storage space formed therein, wherein the front surface is configured to be opened and closed; and a bottom portion positioned below the body portion. The bottom portion includes: a bottom pad; and an inclined plate having a same height as the bottom pad at a first end thereof and having a slope toward a second end thereof. The inclined plate with the slope installed at the bottom portion of the packing box may allow easy ingress and egress of products into and from a storage space therein.

14 Claims, 8 Drawing Sheets

(a)

(b)

PACKAGING BOX

This application claims the benefit of Korean Patent Application No. 10-2023-0095387, filed on Jul. 21, 2023, which is hereby incorporated by reference as if fully set forth herein.

BACKGROUND

Technical Field

The present disclosure relates to a packaging box having an inclined plate with a slope installed at a bottom portion thereof to allow easy ingress and egress of products into and from a storage space therein.

Discussion of the Related Art

Packaging boxes are widely used for transporting various products. Typically, the packaging box is rectangular in shape, and a product is lifted and loaded into the packaging box while the top surface of the packaging box is opened by folding the packaging box. Thereafter, the packaging box is sealed by applying adhesive tape or similar materials.

To retrieve the product from the packaging box, the adhesive tape or similar materials need to be removed, or the taped portion may be cut open with a knife to open the top surface of the packaging box. Then, the product is lifted out.

However, as the weight or size of the product increases, it becomes more difficult to lift the product. Thus, loading or unloading the product through the top surface of the packaging box becomes challenging.

In particular, with the recent expansion of robot applications, the demand for mobile robots has been increasing in various industrial fields to take part in automation. These mobile robots typically weigh about 50 to 90 kg and have a certain size.

Therefore, it is extremely difficult to lift and load/unload the mobile robot into/from the packaging box according to the aforementioned conventional method. The reason for this is due to the significant force required to lift the mobile robot. Additionally, there is a risk of damaging the packaging box while lifting and loading/unloading the mobile robot into/from the packaging box. As a result, a considerable amount of manpower may be required in the process of packaging and transporting the mobile robot, which causes an increase in labor costs.

In addition, considering the weight and size of the mobile robot, there is a possibility of damage such as tearing to the packaging box in the process of transporting the packaging box. For example, the bottom surface of the packaging box may detach due to the inability to withstand the weight of the mobile robot. Furthermore, as the mobile robot is separated from the packaging box due to the damage to the packing box, the mobile robot may also be damaged.

Moreover, from the economic and environmental perspectives, it is advantageous to transport the mobile robot multiple times through reuse of the packaging box or not to frequently discard the packaging box. Accordingly, there is a need for a reusable packaging box capable of addressing the aforementioned issues.

SUMMARY

The present disclosure relates to a packaging box. More specifically, the present disclosure is to provide a packaging box having an inclined plate with a slope installed at a bottom portion thereof to allow easy ingress and egress of products into and from a storage space therein.

In addition, after a product is loaded into the storage space through the inclined plate, the inclined plate may rotate such that the inclined plate is positioned within the storage space, thereby achieving efficient space utilization.

Furthermore, a structure in which the front surface of a main body portion is opened and closed may minimize damage to the packaging box and allow reuse of the packaging box, which may be advantageous from both economic and environmental perspectives.

It will be appreciated by persons skilled in the art that the objects that could be achieved with the present disclosure are not limited to what has been particularly described hereinabove and the above and other objects that the present disclosure could achieve will be more clearly understood from the following detailed description.

To achieve these objects and other advantages and in accordance with the purpose of the disclosure, as embodied and broadly described herein, a packaging box. The packaging box includes: a main body portion having a front surface and a storage space formed therein, wherein the front surface is configured to be opened and closed; and a bottom portion positioned below the body portion. The bottom portion includes: a bottom pad; and an inclined plate having a same height as the bottom pad at a first end thereof and having a slope toward a second end thereof.

The first end of the inclined plate may be rotatably coupled to the bottom pad. In a first state, a bottom surface of the inclined plate may be configured to be positioned parallel to a bottom surface of the bottom pad. In a second state, the bottom surface of the inclined plate may be configured to be positioned parallel to the front surface of the main body portion.

The main body portion may include first handle holes formed on both side surfaces thereof. The bottom portion may include side pads that extend from both side surfaces of the bottom pad, and the side pads may include second handle holes formed at positions corresponding to positions of the first handle holes.

The main body portion may include a first coupling surface that extends from a top of the front surface. When the front surface is closed, the first coupling surface is configured to overlap with a portion of a top surface of the main body portion.

The main body portion may include a second coupling surface that extends from one end of a side surface and is configured to overlap with a portion of the front surface.

The main body portion and the bottom portion may be made of synthetic resin including polypropylene (PP).

The inclined plate may be made of ethylene vinyl acetate (EVA).

The packing box may further include a cushioning member attached to an inner surface of the main body portion and a top surface of the bottom pad.

The cushioning member is made of synthetic resin including polyethylene (PE).

According to the present disclosure, an inclined plate with a slope is installed at a bottom portion of a packaging box to allow easy ingress and egress of products into and from a storage space of the packaging box.

In addition, after a product is loaded into the storage space through the inclined plate, the inclined plate may rotate such that the inclined plate is positioned within the storage space, thereby achieving efficient space utilization.

Furthermore, a structure in which the front surface of a main body portion is opened and closed may minimize damage to the packaging box and allow reuse of the packaging box, which may be advantageous from both economic and environmental perspectives.

The effects that are achievable by the present disclosure are not limited to what has been particularly described hereinabove and other advantages not described herein will be more clearly understood by persons skilled in the art from the following description.

BRIEF DESCRIPTION OF THE DRAWINGS

The accompanying drawings, which are included to provide a further understanding of the disclosure and are incorporated in and constitute a part of this application, illustrate embodiment(s) of the disclosure and together with the description serve to explain the principle of the disclosure. In the drawings.

DETAILED DESCRIPTION

Description will now be given in detail according to exemplary embodiments disclosed herein, with reference to the accompanying drawings. The same or equivalent components may be provided with the same reference numbers, and description thereof will not be repeated. As used herein, the suffixes "module" and "part" are added or used interchangeably to facilitate preparation of this specification and are not intended to suggest distinct meanings or functions. In describing embodiments disclosed in this specification, relevant well-known technologies may not be described in detail in order not to obscure the subject matter of the embodiments disclosed in this specification. In addition, it should be noted that the accompanying drawings are only for easy understanding of the embodiments disclosed in the present specification, and should not be construed as limiting the technical spirit disclosed in the present specification. As such, the present disclosure should be construed to extend to any alterations, equivalents and substitutes in addition to those which are particularly set out in the accompanying drawings.

Although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, it will be understood that when an element is referred to as being "directly connected with" another element, there are no intervening elements present.

A singular representation may include a plural representation unless it represents a definitely different meaning from the context.

The terms such as "include" or "have" used herein are intended to indicate that features, numbers, steps, operations, elements, components, or combinations thereof used in the following description exist and it should be thus understood that the possibility of existence or addition of one or more different features, numbers, steps, operations, elements, components, or combinations thereof is not excluded.

Figure 1:
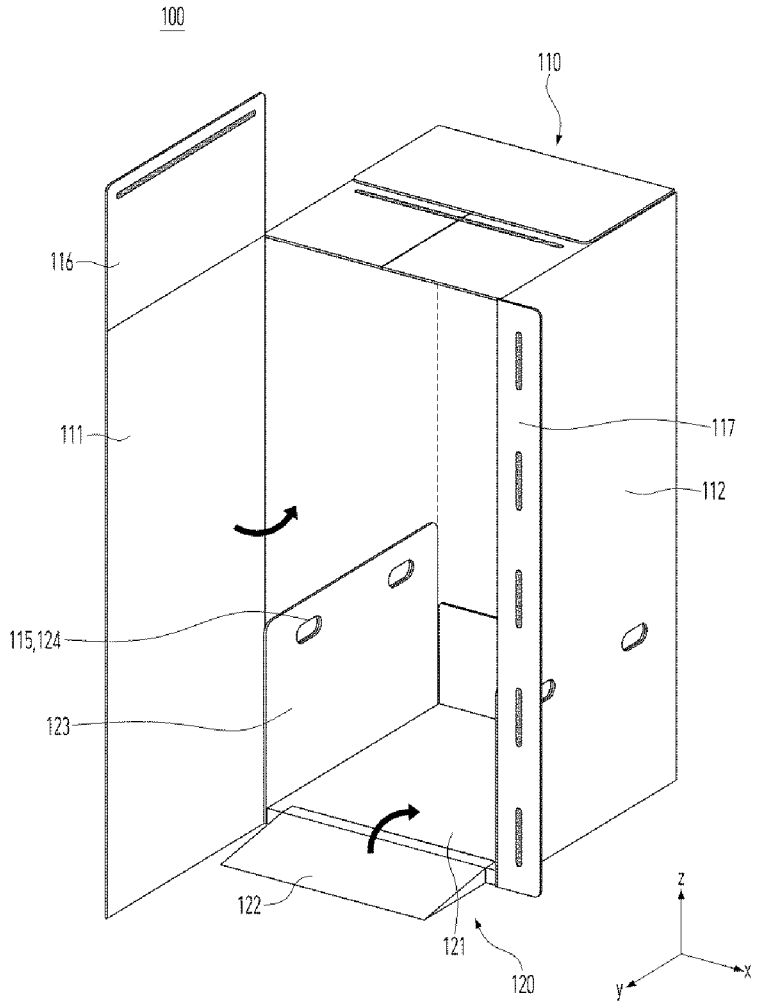
FIG. 1 is a perspective view of a packaging box according to an embodiment of the present disclosure.

FIG. 1 is a perspective view of a packaging box 100 according to an embodiment of the present disclosure.

Herein, the side direction of the packaging box 100 is defined as the x-axis direction, the front or rear direction of the packaging box 100 is defined as the y-axis direction, and the vertical direction of the packaging box 100 is defined as the z-axis direction.

The packaging box 100 according to an embodiment of the present disclosure may include a main body portion 110 and a bottom portion 120. The main body portion 110 has a front side 111 configured be opened and closed, and a storage space may be formed inside the main body portion 110. The storage space may accommodate products to be transported. Additionally, the bottom portion 120 may be positioned below the main body portion 110.

As described above, in the case of the conventional packaging box, it may be difficult to load and unload a product into and from the storage space thereof as the weight or size of the product increases.

Accordingly, the present disclosure aims to provide the packaging box 100 capable of efficiently loading or unloading a product into or from the storage space of the packaging box 100 even if the product is heavy or large in size.

In addition, considering that the demand for mobile robots has been increasing in various industries to take part in automation with the recent expansion of robot applications as described above, the packaging box 100 according to an embodiment of the present disclosure may be efficient for transporting the mobile robots.

Here, the bottom portion 120 may include a bottom pad 121 and an inclined plate 122. In particular, the inclined plate 122 may have the same height as the bottom pad 121 at a first end thereof and have a slope toward a second end thereof. In addition, the first end of the inclined plate 122 may be rotatably coupled to the bottom pad 121.

Additionally, the main body portion 110 may include first handle holes 115 formed on both side surfaces 112 thereof. The bottom portion 120 may include side pads 123 that extend from both side surfaces of the bottom pad 121. In addition, the side pad 123 may include second handle holes 124 formed at positions corresponding to those of the first handle holes 115.

The main body portion 110 may include a first coupling surface 116 that extends from the top of a front surface 111 and a second coupling surface 117 that extends from one end of the side surface 112.

Figure 2:
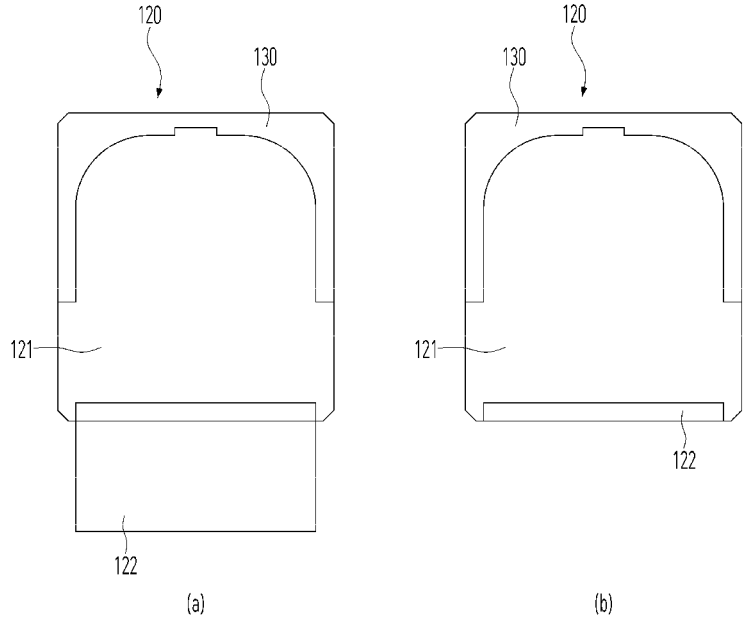
FIG. 2 is a top view of a bottom portion of the packaging box according to an embodiment of the present disclosure.
Figure 3:
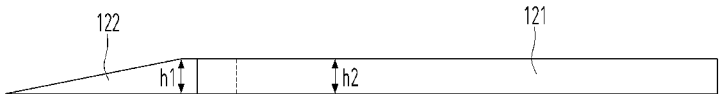
FIG. 3 is a side view of the bottom portion of the packaging box according to an embodiment of the present disclosure.
Figure 3:
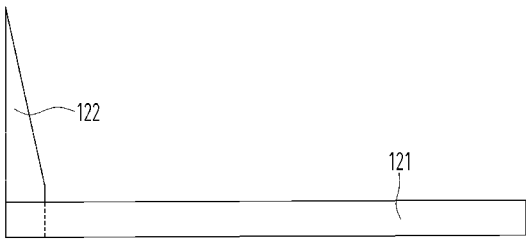

FIG. 2 is a top view of the bottom portion 120 of the packaging box 100 according to an embodiment of the present disclosure. FIG. 3 is a side view of the bottom portion 120 of the packaging box 100 according to an embodiment of the present disclosure.

In the packaging box 100 according to one embodiment of the present disclosure, the bottom portion 120 may be positioned below the main body portion 110. The bottom portion 120 may include the bottom pad 121 and the inclined plate 122. A height h1 of the first end of the inclined plate 122 is the same as a height h2 of the bottom pad 121, and the slope may be formed toward the second end of the inclined plate 122.

In addition, the first end of the inclined plate 122 may be rotatably coupled to the bottom pad 121. Accordingly, in a first state, the bottom surface of the inclined plate 122 may be positioned parallel to the bottom surface of the bottom pad 121. In a second state, the bottom surface of the inclined plate 122 may be positioned parallel to the front surface 111 of the main body portion 110.

The first state may refer to a state in which the front surface 111 of the main body portion 110 is open, and the second state may refer to a state in which the front surface 111 of the main body portion 110 is closed.

In other words, in the first state, the front surface 111 of the main body portion 110 may be open such that the mobile robot is allowed to be loaded into or unloaded from the storage space of the packaging box 100. In the second state, the mobile robot may be positioned inside the storage space of the packaging box 100.

The inclined plate 122 in the first state is shown in (a) of FIG. 2 and (a) of FIG. 3, and the inclined plate 122 in the second state is shown in (b) of FIG. 2 and (b) of FIG. 3.

Referring to FIG. 1, as described above, the packaging box 100 according to an embodiment of the present disclosure allows the front surface 111 of the main body portion 110 to be opened and closed. The inclined plate 122, which is coupled to the bottom pad 121 of the bottom portion 120, allows mobile robots of a certain weight and size to be easily loaded into or unloaded from the storage space.

In other words, the packaging box 100 according to an embodiment of the present disclosure has a structure in which the front surface 111 is opened and closed, rather than a structure in which a top surface 113 thereof is opened and closed. The packaging box 100 may allow the mobile robot to move through the inclined plate 122 with the slope, thereby easily loading or unloading the mobile robot into or from the storage space.

Therefore, according to an embodiment of the present disclosure, there is no need to lift the mobile robot. That is, the mobile robot may be easily loaded into or unloaded from the storage space with minimal effort. Additionally, the mobile robot may autonomously move into or out of the storage space of the packaging box 100 by controlling the movement of the mobile robot.

In the packaging box 100 according to an embodiment of the present disclosure, since the height h1 of the first end of the inclined plate 122 is the same as the height h2 of the bottom pad 121, the mobile robot may move between the inclined plate 122 and the bottom pad 121 without any obstructions.

Therefore, the packaging box 100 according to an embodiment of the present disclosure may solve the aforementioned issues such as damage to the packaging box 100 that may occur during the process of lifting the mobile robot or increases in labor costs that may arise during packaging and transportation.

In addition, as described above, the structure in which the front surface 111 of the main body portion 110 is opened and closed minimizes damage to the packaging box 100 while the mobile robot is loaded into or unloaded from the storage space. This allows the reuse of the packaging box 100, which may be advantageous from both the economic and environmental perspectives.

In addition, after the mobile robot enters the storage space, the inclined plate 122 may rotate such that the inclined plate 122 is positioned within the storage space. That is, as shown in (b) of FIG. 2 and (b) of FIG. 3, the inclined plate 122 may rotate in the second state in which the mobile robot is positioned within the storage space.

Referring to FIG. 1, the packaging box 100 according to an embodiment of the present disclosure allows the front surface 111 of the main body portion 110 to be opened and closed. When the front surface 111 of the main body portion 110 is closed, that is, in the second state, the bottom surface of the inclined plate 122 may be positioned parallel to the front surface 111 of the main body portion 110.

In the second state, the inclined plate 122 may support the underside of the mobile robot, which is loaded into the storage space, thereby preventing the movement of the mobile robot during transportation of the packaging box 100.

In the packaging box 100 according to an embodiment of the present disclosure, the first end of the inclined plate 122 may be coupled to the bottom pad 121 through a shaft that serves as a hinge or pivot, and the coupling may enable the rotation of the inclined plate 122. Alternatively, the inclined plate 122 may fit into a groove formed at one end of the bottom pad 121, which enables the rotation of the inclined plate 122 around the bottom pad 121.

Figure 4:
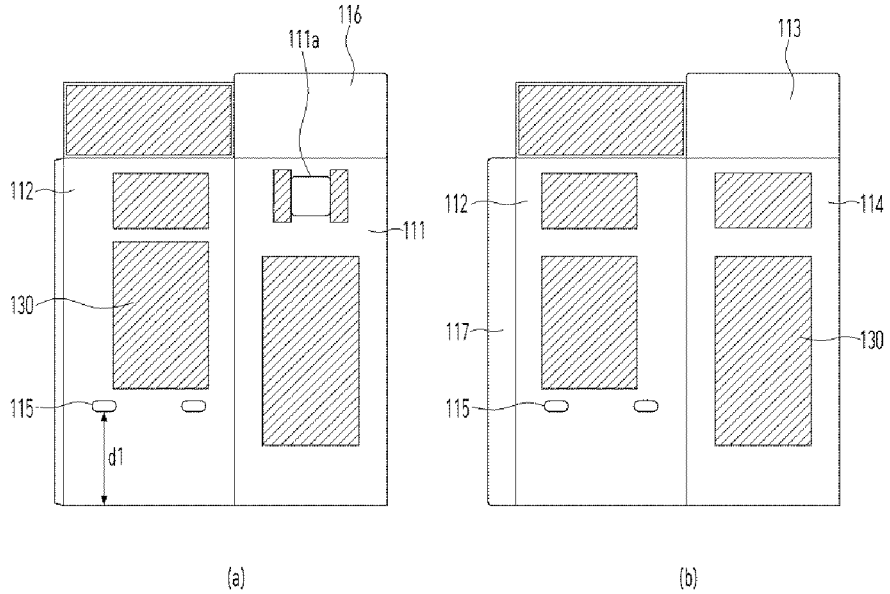
FIG. 4 is an exploded view of a main body portion of the packaging box according to an embodiment of the present disclosure.
Figure 5:
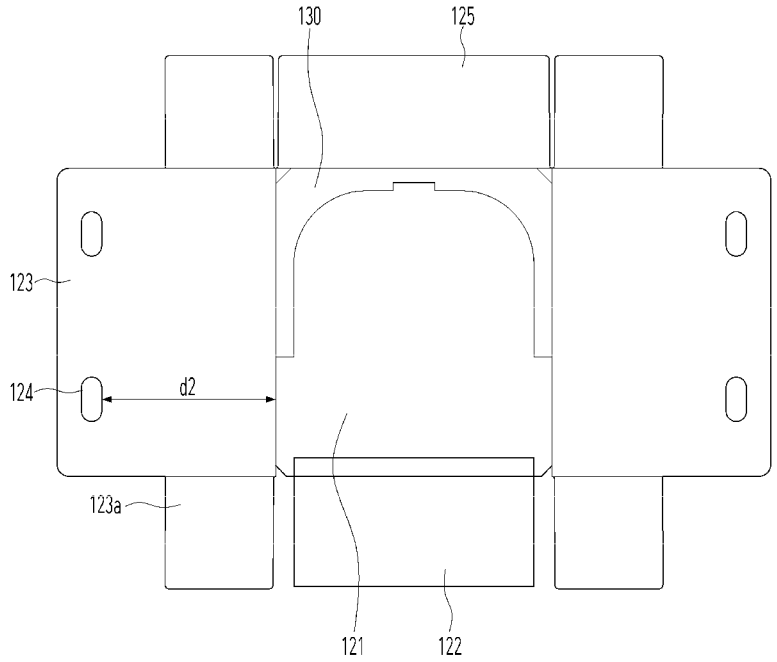
FIG. 5 is an exploded view of the bottom portion of the packaging box according to an embodiment of the present disclosure.

FIG. 4 is an exploded view of the main body portion 110 of the packaging box 100 according to an embodiment of the present disclosure. FIG. 5 is an exploded view of the bottom portion 120 of the packaging box 100 according to an embodiment of the present disclosure.

In FIG. 4, (a) shows an exploded view of the main body portion 110 when the front surface 111 and the side surface 112 are connected, and (b) shows an exploded view of the main body portion 110 when the top surface 113, a rear surface 114, and the side surface 112 are connected. In other words, the packaging box 100 according to an embodiment of the present disclosure may include the front surface 111, the top surface 113, the rear surface 114, and both the side surfaces 112, which allows the formation of the above-described storage space.

Referring to FIG. 1, the main body portion 110 may include the first coupling surface 116 extending from the top of the front surface 111. The first coupling surface 116 may overlap with a portion of the top surface 113 of the main body portion 110 when the front surface 111 of the main body portion 110 is closed.

In addition, the main body portion 110 may include the second coupling surface 117 that extends from the one end of the side surface 112. The second coupling surface 117 may overlap with a portion of the front surface 111 of the main body portion 110 when the front surface 111 of the main body portion 110 is closed.

Therefore, as described above, after the mobile robot enters into the storage space, the inclined plate 122 may rotate such that the inclined plate 122 is positioned within the storage space. Then, the front surface 111 of the main body portion 110 may be closed.

To seal the packaging box 100, the first coupling surface 116 extending from the top of the front surface 111 of the main body portion 110 may be folded such that the first coupling surface 116 overlaps with a portion of the top surface 113 of the main body portion 110.

In addition, the second coupling surface 117 extending from the one end of the side surface 112 of the main body portion 110 may be folded such that the second coupling surface 117 overlaps with a portion of the front surface 111 of the main body portion 110.

Then, the packaging box 100 of the present disclosure may be sealed by applying a separate adhesive member to the first coupling surface 116 and the second coupling surface 117.

In addition, in the packaging box 100 according to an embodiment of the present disclosure, the main body portion 110 may include the first handle holes 115 formed on both the side surfaces 112. As shown in FIG. 5, the bottom portion 120 may include the side pads 123 that extend from both the side surfaces of the bottom pad 121. The side pad 123 may include the second handle holes 124.

In particular, the second handle holes 124 may be formed at the positions corresponding to those of the first handle holes 115. In other words, a length d1 shown in (a) of FIG. 4 and a length d2 shown in FIG. 5 may be the same.

This is to prevent the main body portion 110 and the bottom portion 120 from being separated from each other during the transportation of the packaging box 100 by considering the weight and size of the moving robot as described above with reference to FIG. 1.

In other words, while transporting the packaging box 100 of the present disclosure, a person may simultaneously hold the first handle holes 115 and the second handle holes 124, which are formed at the positions corresponding to those of the first handle hole 115.

Therefore, the main body portion 110 and the bottom portion 120 may be coupled by holding the first handle holes 115 and the second handle holes 124. This allows more convenient transportation and addresses the issue of the moving robot being damaged when there is damage to the packaging box 100 during the transportation of the packaging box 100.

Referring to FIG. 1, FIG. 3, and FIG. 5 together, in the packaging box 100 according to an embodiment of the present disclosure, the bottom portion 120 may additionally include wing pads 123*a* and rear pads 125 that may be attached to the rear surface 114 of the main body portion 110 or the bottom surface of the inclined plate 122 in the second state. The wing pads 123*a* and rear pads 125 may enhance the attachment strength between the main body portion 110 and the bottom portion 120.

Referring to FIG. 4 and FIG. 5 together, the packaging box 100 according to an embodiment of the present disclosure may include additional a cushioning member 130 that may be attached to the inner surface of the main body portion 110 and the top surface of the bottom pad 121. The cushioning member 130 may be made of synthetic resin including polyethylene (PE).

The cushioning member 130 may also fix the mobile robot loaded into the storage space, thereby preventing the mobile robot from moving during the transportation of the packaging box 100. In addition, the cushioning member 130 may prevent damage to the mobile robot by absorbing impacts exerted on the mobile robot during the transportation of the packaging box 100. Furthermore, the cushioning member 130 may prevent the packaging box 100 from being damaged by preventing the movement of the mobile robot.

In the packaging box 100 according to an embodiment of the present disclosure, the main body portion 110 and the bottom portion 120 may be made of synthetic resin including polypropylene (PP). In other words, the packaging box 100 of the present disclosure may be a box made of synthetic resin commonly referred to as "danpla box".

The main components of the synthetic resin used in the manufacturing of the packaging box 100 according to an embodiment of the present disclosure may include PE or polypropylene copolymer as well as PP as described above.

When the packaging box 100 of the present disclosure is manufactured using PP as the main components, a sheet material in the plate state may be cut into specific shapes to form the components required for the packaging box 100. Embodiments related to this process are illustrated in FIG. 4 and FIG. 5. Subsequently, the cut sheet material may be folded to assemble and complete the packaging box 100 of the present disclosure.

In addition, the inclined plate 122 in the packaging box 100 according to an embodiment of the present disclosure may be made of ethylene vinyl acetate (EVA). In other words, the inclined plate 122 may be made of synthetic resin including PP and EVA, which makes the inclined plate 122 lightweight and sturdy. This may reduce the overall weight of the packaging box 100 with the inclined plate 122 and support the mobile robot robustly while the mobile robot moves through the inclined plate 122.

Figure 6:
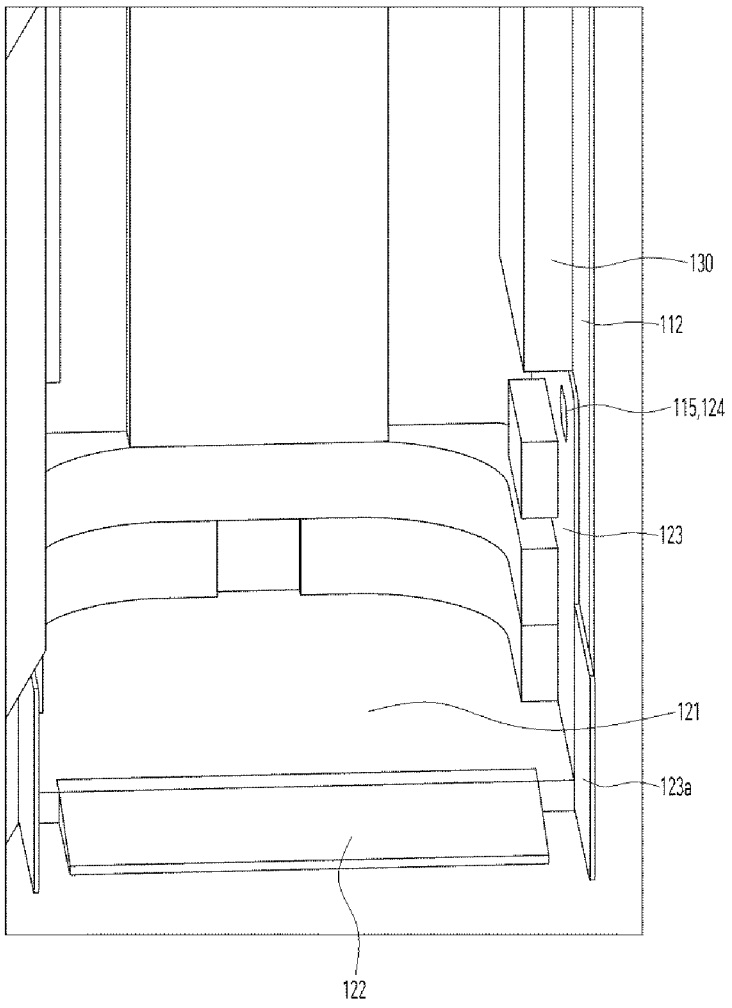
FIGS. 6 to 8 are views illustrating a method of assembling the packaging box according to an embodiment of the present disclosure.
Figure 7:
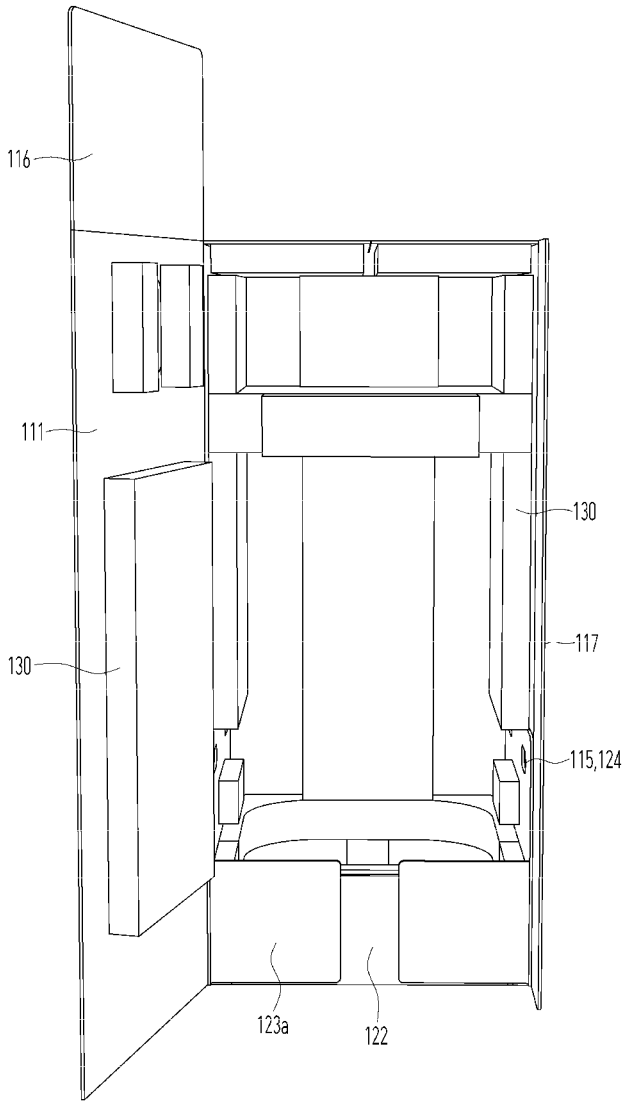
Figure 8:
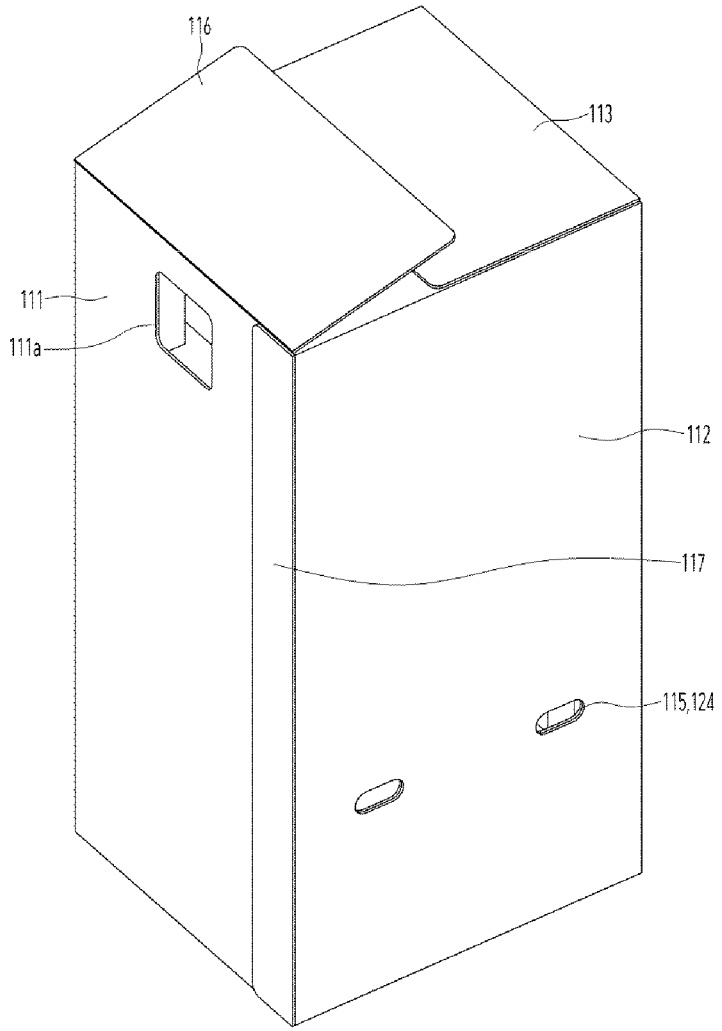

FIGS. 6 to 8 are views illustrating a method of assembling the packaging box 100 according to an embodiment of the present disclosure.

First, as shown in FIG. 6, the mobile robot may move into the storage space in the first state in which the front surface 111 of the main body portion 110 is open and the bottom surface of the inclined plate 122 is positioned parallel to the bottom surface of the bottom pad 121.

Thereafter, the inclined plate 122 may rotate such that the inclined plate 122 is positioned within the storage space as shown in FIG. 7. In this case, as described above, the inclined plate 122 may support the underside of the loaded mobile robot together with the cushioning member 130, and the inclined plate 122 may also function to prevent the movement of the moving robot.

In the second state in which the front surface 111 of the main body portion 110 is closed, the bottom surface of the inclined plate 122 may be positioned parallel to the front surface 111 of the main body portion 110 and may come into contact with the front surface 111 of the main body portion 110 as shown in FIG. 8.

The first coupling surface 116 that extends from the top of the front surface 111 of the main body portion 110 may be folded such that the first coupling surface 116 overlaps with a portion of the top surface 113 of the main body portion 110. In addition, the second coupling surface 117 that extends from the one end of the side surface 112 of the main body portion 110 may be folded such that the second coupling surface 117 overlaps with a portion of the front surface 111. In this case, the packaging box 100 of the present disclosure may be sealed by applying a separate adhesive member to the first coupling surface 116 and the second coupling surface 117 as described above.

Additionally, as shown in FIG. 4 and FIG. 8, the packaging box 100 according to an embodiment of the present disclosure may further include an exposure hole 111*a* on the front surface 111 of the main body portion 110. The exposure hole 111*a* may serve to enable identification of the mobile robot loaded into the storage space.

In summary, the packaging box according to the present disclosure includes the inclined plate with the slope at the bottom thereof, thereby easily loading or unloading products into or from the storage space. Additionally, after a product is loaded into the storage space through the inclined plate, the inclined plate may rotate such that the inclined plate is positioned within the storage space, thereby achieving efficient space utilization. The structure in which the front surface of the main body portion is opened and closed may minimize damage to the packaging box and allow the reuse of the packaging box, which may be advantageous from both the economic and environmental perspectives.

The above detailed description is to be construed in all aspects as illustrative and not restrictive. The scope of the present disclosure should be determined by reasonable interpretation of the appended claims and all changes coming within the equivalency range of the present disclosure are intended to be embraced in the scope of the present disclosure.

What is claimed is:

1. A packaging box comprising:

a main body portion having a front part and a storage space formed therein, wherein the front part is configured to be opened and closed; and a bottom portion positioned below the main body portion, the bottom portion comprising:

a bottom pad comprising a groove formed at one end thereof; and an inclined plate positioned at the one end of the bottom pad in a first state or a second state, wherein the inclined plate comprises:

a first surface positioned on a top side in the first state;

a second surface positioned on a bottom side in the first state;

a first end having a height corresponding to the bottom pad;

a second end having a lower height than the first end;

wherein in the first state, the first end of the inclined plate fits into the groove so that the first surface of the inclined plate forms a slope toward the second end, and the second surface of the inclined plate forms a continuous surface with a bottom surface of the bottom pad, and wherein in the second state, the first end of the inclined plate fits into the groove so that the second surface of the inclined plate faces the front part of the main body portion.

2. The packaging box of claim 1, wherein the main body portion comprises first handle holes formed on both side surfaces thereof, wherein the bottom portion further comprises side pads extending from both side surfaces of the bottom pad, and wherein the side pads comprise second handle holes formed at positions corresponding to positions of the first handle holes.

3. The packaging box of claim 2, wherein, in the second state, the inclined plate is located vertically between the side pads of the bottom portion and a rear surface of the bottom portion.

4. The packaging box of claim 3, wherein, in the second state, a central portion of the inclined plate is exposed to an outside of the packaging box between the side pads of the bottom portion when the packaging box is viewed from a front side.

5. The packaging box of claim 1, wherein the main body portion comprises a first coupling surface extending from a top of the front part, and wherein based on the front part being closed, the first coupling surface is configured to overlap with a portion of a top surface of the main body portion.

6. The packaging box of claim 5, wherein the main body portion comprises a second coupling surface extending from one end of a side surface and configured to overlap with a portion of the front part.

7. The packaging box of claim 1, wherein the main body portion and the bottom portion are made of synthetic resin including polypropylene (PP).

8. The packaging box of claim 7, wherein the inclined plate is made of ethylene vinyl acetate (EVA).

9. The packaging box of claim 1, further comprising a cushioning member attached to an inner surface of the main body portion and a top surface of the bottom pad.

10. The packaging box of claim 9, wherein the cushioning member is made of synthetic resin including polyethylene (PE).

11. The packaging box of claim 1, wherein, in the second state, the first surface of the inclined plate is inclined with respect to a vertical direction and the second surface of the inclined plate is flat with respect to the vertical direction.

12. The packaging box of claim 1, wherein a length of the bottom pad is larger than a length of the inclined plate, and wherein a width of the bottom pad is larger than a width of the inclined plate.

13. The packaging box of claim 1, wherein, in the second state, the inclined plate is located parallel to the front part of the main body portion.

14. The packaging box of claim 1, wherein the main body portion comprises an exposure hole located on the front part.

* * * * *